United States Patent [19]

Kümmerl

[11] 4,099,194

[45] Jul. 4, 1978

[54] DEVICE FOR THE WET PROCESSING OF PHOTOSENSITIVE MATERIALS

[75] Inventor: Klaus Kümmerl, Nuremberg, Fed. Rep. of Germany

[73] Assignee: Durst AG. Fabrik Fototechnischer Apparate, Bolzano-Bozen, Italy

[21] Appl. No.: 742,175

[22] Filed: Nov. 16, 1976

[30] Foreign Application Priority Data

Nov. 20, 1975 [IT] Italy ..... 4858 A/75

[51] Int. Cl.[2] ..... G03D 3/13

[52] U.S. Cl. ..... 354/321; 354/338; 134/64 P; 134/122 P; 118/424

[58] Field of Search ..... 354/297, 319, 316, 320, 354/321, 322, 331, 333, 338, 339, 336; 134/64 P, 122 P; 118/424, 662

[56] References Cited

U.S. PATENT DOCUMENTS

| | | | |
|---|---|---|---|
| 3,137,225 | 6/1964 | Cuthbert | 354/321 |
| 3,359,945 | 12/1967 | Hastings et al. | 354/339 |
| 3,375,770 | 4/1968 | Hellyer | 354/321 |
| 3,662,660 | 5/1972 | Layne | 354/324 |

FOREIGN PATENT DOCUMENTS

| | | | |
|---|---|---|---|
| 1,088,752 | 10/1967 | United Kingdom | 354/339 |

*Primary Examiner*—L. T. Hix
*Assistant Examiner*—Alan Mathews
*Attorney, Agent, or Firm*—Connolly and Hutz

[57] ABSTRACT

A closed container for wet processing photographic strip or sheet materials such as film or printing paper has a cover piece which rests upon several of the conveying rollers. The cover piece has indentations in its lower surface which correspond to the outer surfaces of the rollers to smoothly engage them with intermediate portions of the cover piece being submerged in the processing liquid. This minimizes the contact of the air in the container with the wet surfaces of the rollers partially submerged in the liquid and inbetween them, which thus minimizes oxidation of the processing baths.

6 Claims, 1 Drawing Figure

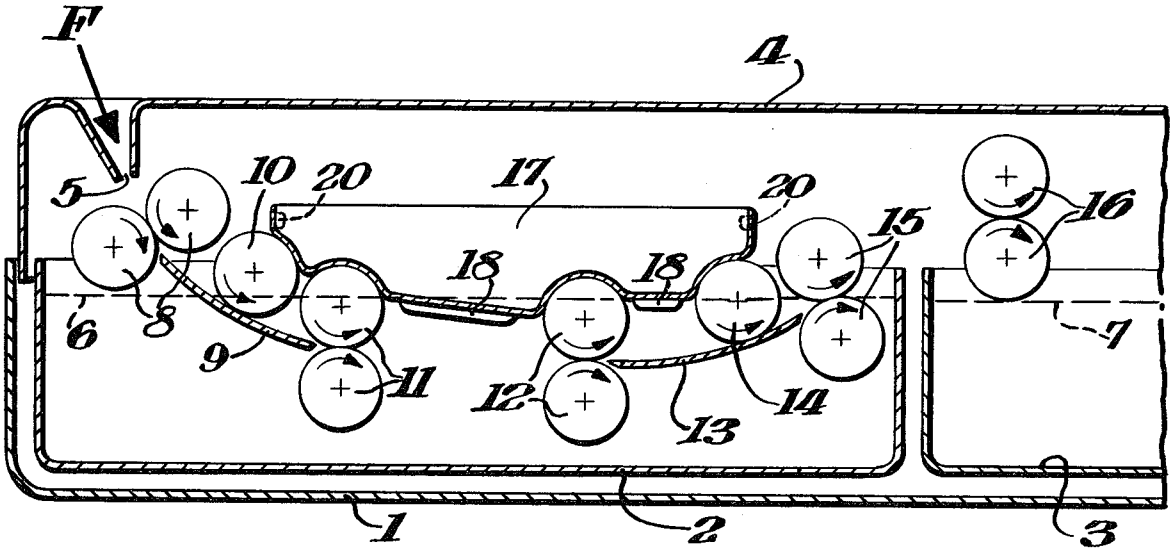
F
5
6
8
9
10
20
11
18
17
12
13
14
15
16
7
4
20
18
2
3
1

DEVICE FOR THE WET PROCESSING OF PHOTOSENSITIVE MATERIALS

BACKGROUND OF THE INVENTION

The invention relates to a device for the wet processing of photosensitive strip or sheet materials, such as photographic emulsion carriers like film and printing paper, wherein strips or sheets are moved by conveying rollers through at least one processing bath.

In known apparatus of this type, the photographic strips or sheets to be processed are conducted usually through a plurality of processing baths, the conveying being performed by pairs of rollers between which the strips or sheets are passed. In most wet processing procedures, it is necessary that the processing baths have a cetain temperature which is usually above room temperature and is maintained by a heating and temperature control device. For a uniform temperature distribution and mixing of the processing baths, there is provided a usually electrically driven pump. The temperature rise as compared to the surrounding temperature and the circulation of the processing baths by means of the pump accelerate the oxidation of the baths and strongly reduce their useful life. For energy-conserving reasons and in order to avoid the oxidation susceptibility of the processing baths, known devices are provided with removable lids which perform the additional task of protecting the emulsion carriers from light incidence, so that their processing is also possible in a bright room. However, the volume of air situated over the processing baths is so great that the oxidation cannot be reduced to a satisfactory extent. Also, such a lid cannot prevent the air exchange occurring over the inlet and outlet openings for the strip or sheet material, which also increases oxidation of the processing baths.

The object of the invention is to provide a device of the initially mentioned type, wherein oxidation of the processing baths is reduced as compared to previously known devices.

SUMMARY

In accordance with this invention a cover piece having indentations on its lower surface is disposed in direct contact over the conveying rollers, which are partially immersed in a bath through which photographic strip or sheet materials are conveyed by the rollers to process them. The cover piece may also advantageously dip below the surface of the liquid in portions intermediate the rollers. This minimizes the contact of the processing bath disposed in a film on the rollers and inbetween them with the air in the container. This minimizes oxidation and deterioration of the baths. The submerged portions of the cover piece may include ribs for helping guide the strip or sheet material through the bath and preventing it from rising above the surface.

By means of the novel design of the device, a large part of the surface of the processing baths is covered in such a manner that they no longer come in contact with the surrounding air.

In this connection, it is particularly advantageous that the conveying rollers, which generally participate in the oxidation of the processing baths in that they have a liquid film, which is replenished with each revolution and wherein such liquid film comes on contact with the surrounding air, are covered in this manner, whereby the oxidation is strongly reduced as compared to known devices.

The area of the protective lid dipping into the processing baths between the conveying rollers prevents air access to the zone of the processing bath wherein the flow of liquid caused by the pump is the strongest and also the oxidation without protective cover piece is most intensive.

An advantage of the novel device comprises furthermore that the part of the protective cover piece dipping into the processing bath between the conveying rollers can take over the conveyance of the strip or sheet material in this area.

In addition, the novel protective cover also serves in an advantageous manner as spray protection, which prevents thereby even only small quantities of a processing bath from reaching those of an adjacent processing bath if one of the baths is to be refilled or is to be regenerated before the other.

Furthermore, the novel cover also offers an actual protection from bath intermixture which often set in when the condensate forming within the cover as a result of a slight incline of the device effected by an uneven base wanders along the inside surface of the device and is deposited in adjacent baths.

BRIEF DESCRIPTION OF THE DRAWING

Novel features and advantages of the present invention will become apparaent to one skilled in the art from a reading of the following description in conjunction with the accompanying drawing wherein similar reference characters refer to similar parts and in which the single FIGURE of the drawing shows a highly schematized cross-sectional illustration of a portion of a device which constitutes one embodiment of the invention.

DESCRIPTION OF THE PREFERRED EMBODIMENT

In a (only partially illustrated) container 1, there are provided a plurality of, e.g. three, liquid containers, which serve for the receiving of the processing baths, of which a first liquid container is illustrated in its entirety and is designated by numeral 2 and a second one is just indicated and provided with the reference numeral 3. Container 1 may be closed by a removable cover 4 (only partially illustrated), which contains an inlet slot 5 through which the strip material to be processed may be introduced in the direction of arrow F into the first liquid container 2. In each liquid container is disposed a series of conveying rollers, which are rotated, preferably by means of a drive actuated by an electric motor (not shown) and not illustrated in greater detail, in the direction of the marked arrows, the strip or sheet material (not shown) being moved through the processing bath situated in the particular liquid container. The filling level is indicated by the dotted lines 6 and 7. Should color papers, for example, be developed by means of the device illustrated, liquid container 2 would contain a developing bath; liquid container 3, a stop bath; and a third, non-illustrated liquid container adjacent thereto, a bleach fixing bath. Upon the introduction of the strip or sheet materials, they are first grasped by a pair of intake rollers 8 and conducted over guiding plate 9 and a conveying roller 10 to a further pair of conveying rollers 11. From this point, the strips or sheets reach a third pair of conveying rollers 12 and further over guiding plate 13 and a conveying roller 14 to a fourth pair of conveying rollers 15 which move the strips or sheets from the first liquid container 2 and conduct them to the intake roller pair 16 of the next liquid container 3 wherein the further transport occurs in a similar manner. In the movement through the various liquid containers, the processing baths contained therein react with the photosensitive material on the strips or sheets. In order to improve the efficiency of the processing baths and to assure their uniform temperature distribution and circulation, respectively, they may be whirled around by a non-illustrated pump. Preferably, this pump effects a flow between the conveying roller pairs 11 and 12 transversely to the movement direction of the strips or sheets.

Arranged directly above the conveying rollers, which are in contact with the processing bath, is a protective cover 17, which is shaped in such a manner that it partially encircles the surfaces of the particular conveying rollers which are partially immersed in the liquid and between them dips into the processing bath. Protective cover 17 may be mounted on (non-illustrated) side walls of the liquid containers but it is preferably that it rest directly on the covered conveying rollers; in the instance described, on conveying rollers 10, 11, 12 and 14. Thereby, the liquid film otherwise brought in contact with the surrounding air by the rotation of these conveying rollers, is substantially closed off from the surrounding air, such film has contributed very strongly to the oxidation of the processing bath in that it was regenerated over and over again when being submerged into the processing bath.

The oxidation susceptibility of the processing bath is further reduced in that its surface can no longer come in contact with the surrounding air between the conveying rollers—in the instance illustrated, between conveying rollers 10,11, 12 and 14. Particularly effective is this cover in the area between the pairs of conveying rollers 11 and 12 if the flow, produced by the above-mentioned circulating pump, is operative, since the oxidation with a free surface of the processing bath is particularly strong in this area due to the circulation thereof.

In the stated areas between the conveying rollers, wherein protective cover 17 dips into the processing bath, the cover can also be constructed as guiding means for the emulsion carrier passing through. For this purpose, a plurality of ribs and trough guides 18 are provided on the submerged surface of protective cover 17, preventing a rising of the strips or sheets to the surface.

Protective cover 17 is constructed preferably in the shape of a shell with a concave upper surface and a generally convex lower surface. In such an instance, it forms an effective spray protection if the processing bath in liquid container 3, for example, is poured after that in liquid container 2 or is changed prior thereto. Such spray protection is advantageous, therefore, since a processing bath can become useless even by the admixture of very small quantities of a foreign processing bath.

Similar protection is exercised by protective cover 17 also from intermixing of the processing bath, which take place in that condensed processing liquids can be deposited in an alien bath, the liquids, with a slight incline of cover 4 in relation to the horizontal line, moving along the interior surface of the cover.

A protective cover corresponding to protective cover 17 may of course be provided for all other processing baths, even if it illustrated herein only for the processing bath contained in liquid container 2. It is equally apparent that such a protective cover may be used not only in a device with the given combination of conveying rollers but also in every device for the wet processing of photosensitive strip or sheet material with conveying rollers.

For cleaining the device, protective cover 17 is removed from its base. In order to facilitate the removal, a handle may be mounted, e.g. a grip 20 opening at the edge of the protective cover.

I claim:

1. A device for the wet processing of photosensitive flexible strip or sheet material comprising a container for processing liquid, conveying rollers disposed in the container for conducting the strip or sheet material through the container and the liquid therein, at least some of the conveying rollers being partially disposed in the liquid, characterized in that a cover piece having indentations in a lower surface is disposed in direct contact over at least a portion of the conveying rollers which are partially immersed in the liquid, the indentations in the cover piece corresponding to the surfaces of the conveying rollers with which it is disposed in contact wherein such surfaces of the conveying rollers are smoothly covered from contact with the air in the container, and at least a portion of the cover piece is constructed and arranged to be disposed below the level of the liquid in the container, whereby the liquid is shielded from oxidation from the air, and splashing out of the liquid is prevented.

2. A device as set forth in claim 1 wherein the portion of the cover piece disposed below the liquid level is constructed and arranged to guide the travel of the strip or sheet material and thus to constitute guides.

3. A device as set forth in claim 2 wherein the guides are constructed and arranged to include longitudinal ribs.

4. A device as set forth in claim 1 wherein the cover piece has a substantially concave upper surface and a generally convex lower surface.

5. A device as set forth in claim 1 wherein a handle is provided on the cover piece to facilitate its insertion into and removal from the container.

6. A device as set forth in claim 1 wherein the cover piece rests in direct contact with and is supported by the conveying rollers.

* * * * *